US009863259B2

(12) United States Patent
Boeke et al.

(10) Patent No.: US 9,863,259 B2
(45) Date of Patent: Jan. 9, 2018

(54) CHORDAL SEAL

(71) Applicant: United Technologies Corporation, Hartford, CT (US)

(72) Inventors: Mark A. Boeke, Plainville, CT (US); Kevin Rajchel, Vernon, CT (US); Mosheshe Camara-khary Blake, Manchester, CT (US); Vincent E. Simms, Bloomfield, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 266 days.

(21) Appl. No.: 14/708,939

(22) Filed: May 11, 2015

(65) Prior Publication Data

US 2016/0333712 A1 Nov. 17, 2016

(51) Int. Cl.

| | |
|---|---|
| ***F01D 9/04*** | (2006.01) |
| ***F04D 11/00*** | (2006.01) |
| ***F01D 11/00*** | (2006.01) |
| ***F01D 25/24*** | (2006.01) |

(52) U.S. Cl.

CPC ..... *F01D 9/042* (2013.01); *F01D 11/006* (2013.01); *F01D 25/246* (2013.01); *F05D 2240/57* (2013.01)

(58) Field of Classification Search

CPC ..... F01D 9/041; F01D 9/042; F01D 11/005; F01D 11/006; F05D 2220/32; F05D 2230/10; F05D 2240/57; F05D 2240/80

See application file for complete search history.

(56) References Cited

U.S. PATENT DOCUMENTS

| | | | | |
|---|---|---|---|---|
| 3,909,155 | A | 9/1975 | Whinfrey | |
| 4,194,869 | A * | 3/1980 | Corcokios | F01D 9/042 415/189 |
| 4,384,822 | A * | 5/1983 | Schweikl | F01D 9/042 415/115 |
| 4,477,086 | A | 10/1984 | Feder et al. | |
| 4,863,343 | A * | 9/1989 | Smed | F01D 11/005 415/138 |
| 5,149,250 | A * | 9/1992 | Plemmons | F01D 9/042 415/209.2 |
| 5,839,878 | A | 11/1998 | Maier | |
| 5,848,874 | A * | 12/1998 | Heumann | F01D 9/042 411/24 |
| 6,343,463 | B1 * | 2/2002 | Mei | F01D 25/246 415/115 |
| 6,599,089 | B2 | 7/2003 | Aksit et al. | |

(Continued)

FOREIGN PATENT DOCUMENTS

| | | |
|---|---|---|
| EP | 0343361 | 11/1989 |
| EP | 1057975 | 12/2000 |

OTHER PUBLICATIONS

Extended European Search Report for European Application No. 16169048.2 dated Sep. 16, 2016.

*Primary Examiner* — Igor Kershteyn

(74) *Attorney, Agent, or Firm* — Carlson, Gaskey & Olds, P.C.

(57) ABSTRACT

An airfoil for a gas turbine engine includes a first airfoil. A first chordal seal is located adjacent a first end of the airfoil. A second chordal seal is located adjacent a second end of the airfoil. The first chordal seal includes a first edge parallel to a first edge on the second chordal seal.

20 Claims, 3 Drawing Sheets

(56) References Cited

U.S. PATENT DOCUMENTS

| | | | | |
|---|---|---|---|---|
| 6,637,752 | B2 | 10/2003 | Aksit et al. | |
| 6,637,753 | B2 | 10/2003 | Mohammed-Fakir et al. | |
| 6,719,295 | B2 | 4/2004 | Mohammed-Fakir et al. | |
| 6,764,081 | B2 | 7/2004 | Mohammed-Fakir et al. | |
| 7,229,245 | B2 * | 6/2007 | Ellis | F01D 9/041 415/135 |
| 7,753,648 | B2 * | 7/2010 | Evans | F01D 5/16 415/191 |
| 8,070,427 | B2 | 12/2011 | Snook et al. | |
| 8,360,716 | B2 * | 1/2013 | Bergman | F01D 9/02 415/190 |
| 8,459,041 | B2 * | 6/2013 | Flanagan | F01D 9/023 60/752 |

* cited by examiner

CHORDAL SEAL

BACKGROUND

A gas turbine engine typically includes a fan section, a compressor section, a combustor section, and a turbine section. Air entering the compressor section is compressed and delivered into the combustion section where it is mixed with fuel and ignited to generate a high-speed exhaust gas flow. The high-speed exhaust gas flow expands through the turbine section to drive the compressor and the fan section.

Gas turbine stator vane assemblies typically include a plurality of vane segments which collectively form the annular vane assembly. Each vane segment includes one or more airfoils extending between an outer platform and an inner platform. The inner and outer platforms collectively provide radial boundaries to guide core gas flow past the airfoils. Core gas flow may be defined as gas exiting the compressor passing directly through the combustor and entering the turbine.

Vane support rings support and position each vane segment radially inside of the engine diffuser case. In most instances, cooling air bled off of the fan is directed into an annular region between the diffuser case and an outer case, and a percentage of compressor air is directed in the annular region between the outer platforms and the diffuser case, and the annular region radially inside of the inner platforms.

The fan air is at a lower temperature than the compressor air, and consequently cools the diffuser case and the compressor air enclosed therein. The compressor air is at a higher pressure and lower temperature than the core gas flow which passes on to the turbine. The higher pressure compressor air prevents the hot core gas flow from escaping the core gas flow path between the platforms. The lower temperature of the compressor flow keeps the annular regions radially inside and outside of the vane segments cool relative to the core gas flow.

SUMMARY

In one exemplary embodiment, an airfoil for a gas turbine engine includes a first airfoil. A first chordal seal is located adjacent a first end of the airfoil. A second chordal seal is located adjacent a second end of the airfoil. The first chordal seal includes a first edge parallel to a first edge on the second chordal seal.

In a further embodiment of the above, the first chordal seal includes a second edge parallel to a second edge on the second chordal seal.

In a further embodiment of any of the above, a cusp of material is spaced outward from the first chordal seal.

In a further embodiment of any of the above, there is a recess on an opposite side of cusp from the first chordal seal.

In a further embodiment of any of the above, a pair a transition regions extends along a pair of edges of the first chordal seal.

In a further embodiment of any of the above, a pair of transition regions extends along a pair of edges of the second chordal seal.

In a further embodiment of any of the above, there is a second airfoil. The first airfoil and the second airfoil extend between a first platform located at a first end of the first and second airfoils. A second platform is located at a second end of the first and second airfoils.

In a further embodiment of any of the above, the first chordal seal is located on a rail located on an opposite side of a first platform from the first airfoil.

In another exemplary embodiment, a vane for a gas turbine engine includes an airfoil that extends between an inner platform and an outer platform. A first chordal seal is located adjacent the inner platform. A second chordal seal is located adjacent the outer platform. The first chordal seal includes a first edge parallel to a first edge on the second chordal seal.

In a further embodiment of any of the above, the first chordal seal includes a second edge parallel to a second edge on the second chordal seal.

In a further embodiment of any of the above, a cusp of material is located radially inward from the first chordal seal.

In a further embodiment of any of the above, there is a recess on an axially forward side of the cusp from the first chordal seal.

In a further embodiment of any of the above, a pair of transition regions extends along a pair of edges of the first chordal seal.

In a further embodiment of any of the above, a pair of transition regions extends along a pair of edges of the second chordal seal.

In another exemplary embodiment, a method of forming a component for a gas turbine engine includes attaching an airfoil to a fixture, machining a first edge of a first chordal seal adjacent a first end of the airfoil while the component is attached to the fixture and machining a first edge of a second chordal seal adjacent a second end of the airfoil while the component is attached to the fixture.

In a further embodiment of any of the above, a cusp is formed spaced outward from the first chordal seal.

In a further embodiment of any of the above, a recess is formed on an opposite side of the cusp from the first chordal seal.

In a further embodiment of any of the above, a second edge of the first chordal seal adjacent the first end of the airfoil is machined while the component is attached to the fixture. A second edge of the second chordal seal adjacent the second end of the airfoil is machined while the component is attached to the fixture.

The various features and advantages of this disclosure will become apparent to those skilled in the art from the following detailed description. The drawings that accompany the detailed description can be briefly described as follows.

DETAILED DESCRIPTION

Figure 1:
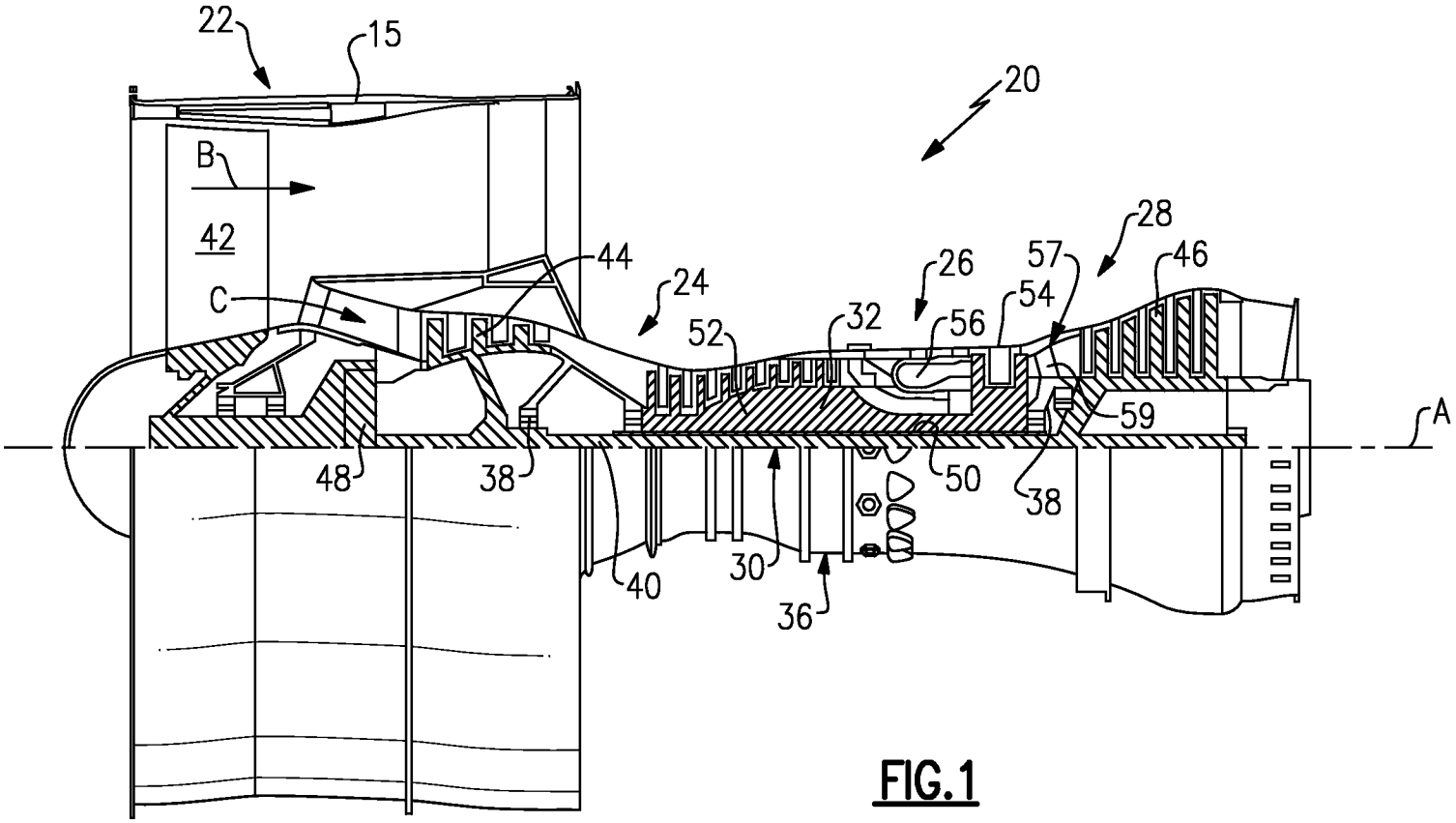
FIG. 1 is a schematic view of an example gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include an augmentor section (not shown) among other systems or features. The fan section 22 drives air along a bypass flow path B in a bypass duct defined within a nacelle 15, while the compressor section 24 drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects a fan 42, a first (or low) pressure compressor 44 and a first (or low) pressure turbine 46. The inner shaft 40 is connected to the fan 42 through a speed change mechanism, which in exemplary gas turbine engine 20 is illustrated as a geared architecture 48 to drive the fan 42 at a lower speed than the low speed spool 30. The high speed spool 32 includes an outer shaft 50 that interconnects a second (or high) pressure compressor 52 and a second (or high) pressure turbine 54. A combustor 56 is arranged in exemplary gas turbine 20 between the high pressure compressor 52 and the high pressure turbine 54. A mid-turbine frame 57 of the engine static structure 36 is arranged generally between the high pressure turbine 54 and the low pressure turbine 46. The mid-turbine frame 57 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The mid-turbine frame 57 includes airfoils 59 which are in the core airflow path C. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of combustor section 26 or even aft of turbine section 28, and fan section 22 may be positioned forward or aft of the location of gear system 48.

The engine 20 in one example is a high-bypass geared aircraft engine. In a further example, the engine 20 bypass ratio is greater than about six (6), with an example embodiment being greater than about ten (10), the geared architecture 48 is an epicyclic gear train, such as a planetary gear system or other gear system, with a gear reduction ratio of greater than about 2.3 and the low pressure turbine 46 has a pressure ratio that is greater than about five. In one disclosed embodiment, the engine 20 bypass ratio is greater than about ten (10:1), the fan diameter is significantly larger than that of the low pressure compressor 44, and the low pressure turbine 46 has a pressure ratio that is greater than about five 5:1. Low pressure turbine 46 pressure ratio is pressure measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.3:1. It should be understood, however, that the above parameters are only exemplary of one embodiment of a geared architecture engine and that the present invention is applicable to other gas turbine engines including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet. The flight condition of 0.8 Mach and 35,000 ft (10,668 meters), with the engine at its best fuel consumption—also known as "bucket cruise Thrust Specific Fuel Consumption ('TSFC')"—is the industry standard parameter of lbm of fuel being burned divided by lbf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of $[(\text{Tram}^\circ\ \text{R})/(518.7^\circ\ \text{R})]^{0.5}$. The "Low corrected fan tip speed" as disclosed herein according to one non-limiting embodiment is less than about 1150 ft/second (350.5 meters/second).

The example gas turbine engine includes fan 42 that comprises in one non-limiting embodiment less than about twenty-six (26) fan blades. In another non-limiting embodiment, fan section 22 includes less than about twenty (20) fan blades. Moreover, in one disclosed embodiment low pressure turbine 46 includes no more than about six (6) turbine rotors schematically indicated at 34. In another non-limiting example embodiment low pressure turbine 46 includes about three (3) turbine rotors. A ratio between number of fan blades 42 and the number of low pressure turbine rotors is between about 3.3 and about 8.6. The example low pressure turbine 46 provides the driving power to rotate fan section 22 and therefore the relationship between the number of turbine rotors 34 in low pressure turbine 46 and number of blades 42 in fan section 22 disclose an example gas turbine engine 20 with increased power transfer efficiency.

Figure 2:
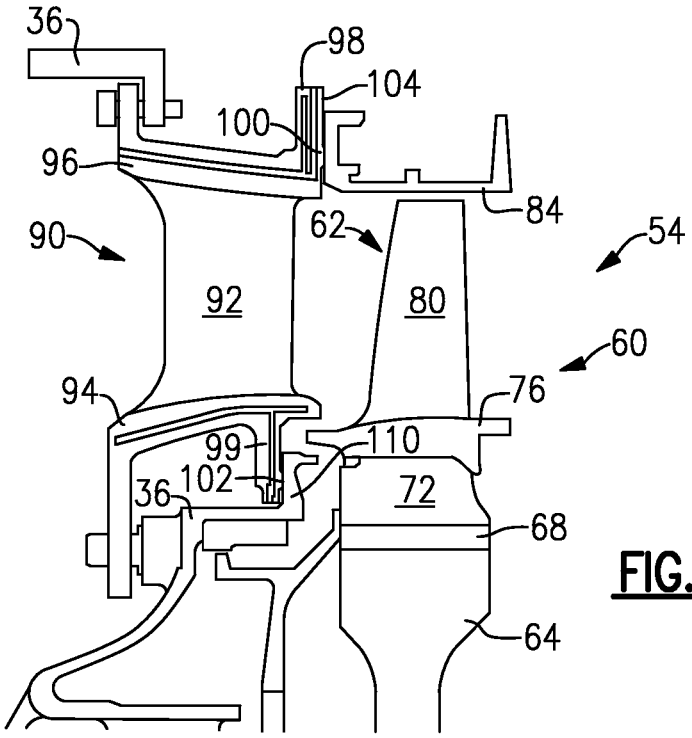
FIG. 2 is a cross-sectional view of a turbine section of the example gas turbine engine of FIG. 1.

FIG. 2 illustrates an enlarged schematic view of the high pressure turbine 54, however, other sections of the gas turbine engine 20 could benefit from this disclosure. In the illustrated example, the high pressure turbine 54 includes a one-stage turbine section with a first rotor assembly 60. In another example, the high pressure turbine 54 could include a two-stage high pressure turbine section.

The first rotor assembly 60 includes a first array of rotor blades 62 circumferentially spaced around a first disk 64. Each of the first array of rotor blades 62 includes a first root portion 72, a first platform 76, and a first airfoil 80. Each of the first root portions 72 is received within a respective first rim 68 of the first disk 64. The first airfoil 80 extends radially outward toward a first blade outer air seal (BOAS) assembly 84.

The first array of rotor blades 62 are disposed in the core flow path that is pressurized in the compressor section 24 then heated to a working temperature in the combustor section 26. The first platform 76 separates a gas path side inclusive of the first airfoils 80 and a non-gas path side inclusive of the first root portion 72.

An array of vanes 90 are located axially upstream of the first array of rotor blades 62. Each of the array of vanes 90 include at least one airfoil 92 that extend between a respective vane inner platform 94 and an vane outer platform 96. In another example, each of the array of vanes 90 include at least two airfoils 92 forming a vane double. The vane outer platform 96 of the vane 90 may at least partially engage the BOAS 84.

Figure 3:
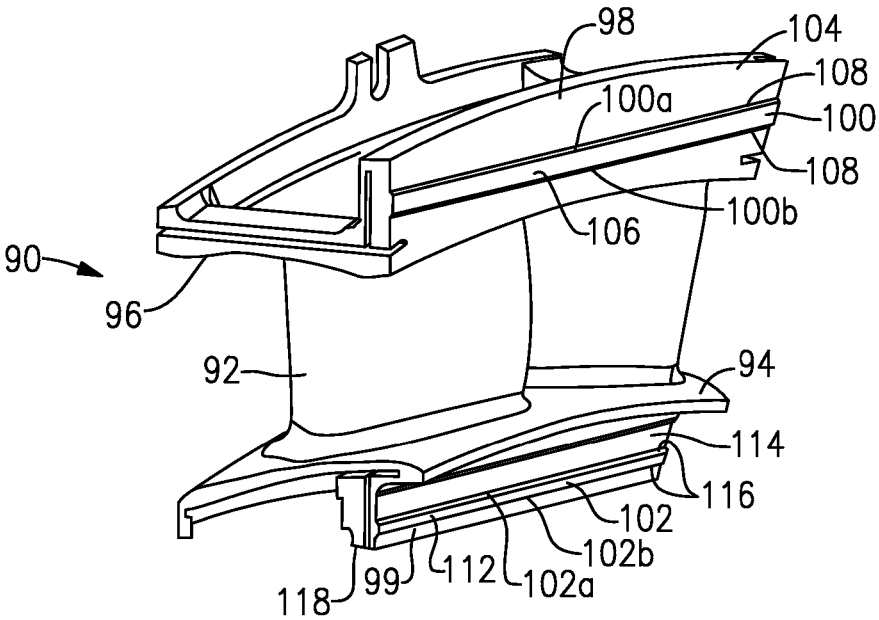
FIG. 3 is a perspective view of an example vane.

As shown in FIGS. 2 and 3, the vane 90 includes an outer chordal seal 100 and an inner chordal seal 102 on an axially downstream end of the vane 90. In this disclosure, axial or axially extending is in relation to the axis A of the gas turbine engine 20. The outer chordal seal 100 creates a seal between the vane 90 and the BOAS 84. The outer chordal seal 100 extends in a chordal direction along an axially facing surface 104 of an outer rail 98. The outer rail 98 extends radially outward from the vane outer platform 96. By having the outer chordal seal 100 extend in the chordal direction, the outer chordal seal 100 will be straight and extend between opposing circumferential ends of the outer rail 98.

The outer chordal seal 100 includes an axially facing surface 106 that faces axially downstream relative to the axis A of the gas turbine engine 20. The axially facing surface 106 is axially spaced from the axially facing surface 104 by a pair of transition regions 108. In the illustrated example, the pair of transition regions 108 includes a pair of fillets having a radius of curvature. In another example, the pair of transition regions 108 includes a pair of angled surfaces.

The inner chordal seal 102 creates a seal between the vane 90 and a portion of the static structure 36. The inner chordal seal 102 extends in a chordal direction along an axially facing surface 114 of an inner rail 99 extending radially inward from the vane inner platform 94. By having the inner chordal seal 102 extend in the chordal direction, the inner chordal seal 102 will be straight and extend between opposing circumferential ends of the vane inner platform 94.

In the illustrated example, the portion of the static structure 36 creating the seal with the inner chordal seal 102 is a flange 110 on a tangent on board injector (TOBI). However, another portion of the static structure 36 could be used to engage the inner chordal seal 102.

The inner chordal seal 102 includes an axially facing surface 112 that faces axially downstream relative to the axis A of the gas turbine engine 20. The axially facing surface 112 is spaced from the axially facing surface 114 by a pair of transition regions 116. In the illustrated example, the pair of transition regions 116 includes a pair of fillets having a radius of curvature. In another example, the pair of transition regions 116 includes a pair of angled surfaces.

Figure 4:
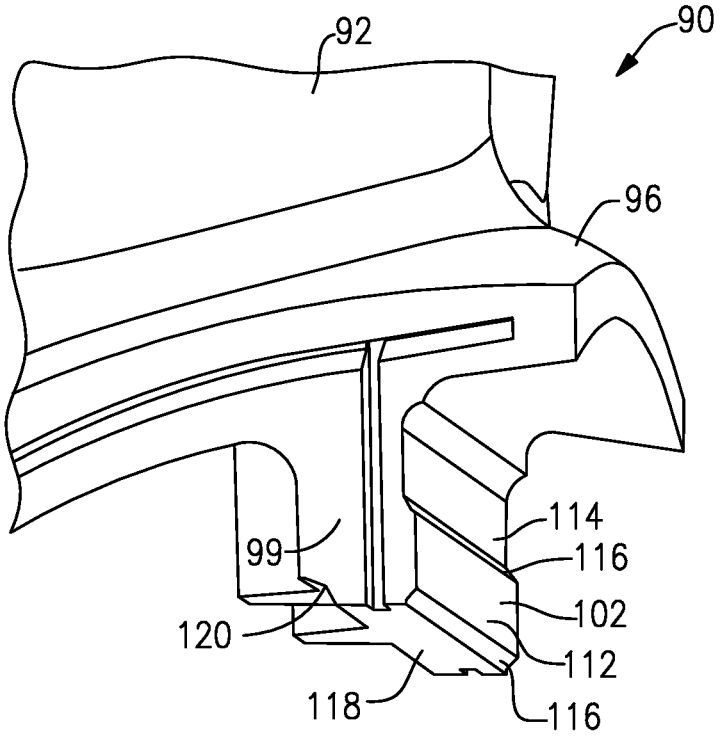
FIG. 4 is an enlarged view of the example vane of FIG. 3.

As shown in FIG. 4, a cusp 118 is located on a radially inner portion of the inner rail 99. The cusp 118 is at least partially defined by one of the transition regions 118 along an axially downstream edge and by a recess 120 along an axially forward edge. In the illustrated example, the recess 120 includes a pair of angled surfaces. In another example, the recess 120 could include a fillet having a radius of curvature.

Axial positions of the outer chordal seal 100 and the inner chordal seal 102 may vary slightly from one another due to manufacturing tolerances and nominal dimensions of the vane 90 in a cold state. Because of the variations in the vane 90, corresponding pairs of edges on the outer chordal seal 100 and inner chordal seal 102 would engage the BOAS 84 and the flange 110, respectively, and form the seal.

In one example, when the vane outer platform 96 is shifted axially rearward of the vane inner platform 94, a first edge 100*a* of the outer chordal seal 100 engages the BOAS 84 and a first edge 102*a* of the inner chordal seal 102 engages the flange 110. In another example, when the vane outer platform 96 is shifted axially forward of the vane inner platform 94, a second edge 100*b* of the outer chordal seal 100 engages the BOAS 84 and a second edge 102*b* of the inner chordal seal 102 engages the flange 110. The first edges 100*a*, 102*a* are located on a radially outer side of the outer chordal seal 100 and the inner chordal seal, respectively, and the second edges 100*b*, 102*b* are located on a radially inner side of the outer chordal seal 100 and the inner chordal seal 102, respectively.

In order to improve the effectiveness of the outer and inner choral seals 100 and 102, the first edge 100*a* must be parallel to the first edge 102*a* and the second edge 100*b* must be parallel to the second edge 102*b*. By improving the parallelism between the corresponding edges on the outer and inner chordal seals 100, 102, the corresponding edges are able to maintain a line of contact with the BOAS 84 and static structure 36, respectively, when the deflection between the static structure 36 attached to the vane outer platform 96 and the static structure 36 attached to inner platform 94 varies.

In order to improve the parallelism and simplify the manufacturing process of the vane 90, the first edges 100*a*, 102*a* and the second edges 100*b*, 102*b* are formed during the same machining process. By forming the first edges 100*a*, 102*a* and the second edges 100*b*, 102*b* in the same jig during machining, variations in parallelism between the first edges 100*a*, 102*a* and the second edges 100*b*, 102*b* is reduced. The variations in parallelism are reduced because the vane 90 does not need to be mounted into a second jig which can reduce parallelism if the vane 90 is not aligned perfectly in the second jig.

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

What is claimed is:

1. A component for a gas turbine engine comprising:

a first airfoil extending between a first platform and a second platform, a first chordal seal including a first aft facing planar surface at least partially defined by a first pair of edges located adjacent the first platform; and a second chordal seal including a second aft facing planar surface at least partially defined by a second pair of edges located adjacent the second platform, wherein at least one of the first pair of edges is parallel to at least one of the second pair of edges.

2. The component of claim 1, wherein both of the first pair of edges are parallel to both of the second pair of edges.

3. The component of claim 1, wherein a first pair of transition surfaces at least partially define a corresponding one of the first pair of edges.

4. The component of claim 3, wherein a second pair of transition surfaces at least partially define a corresponding one of the second pair of edges.

5. The component of claim 1, further comprising a second airfoil extending between the first platform and the second platform.

6. The component of claim 1, further comprising a first rail having a first rail aft surface located on an opposite side of the first platform from the first airfoil and a second rail having a second rail aft surface located on an opposite side of the second platform from the first airfoil, wherein the first chordal seal is located on the first rail aft surface and the second chordal seal is located on the second rail aft surface.

7. The airfoil of claim 6, further comprising a cusp of material on the first rail located radially inward from the first chordal seal.

8. The airfoil of claim 6, further comprising a recess in a forward surface of the first rail, the recess is defined by at least one of a pair or angled surfaces or a fillet.

9. A vane for a gas turbine engine comprising:

an airfoil extending between an inner platform and an outer platform;

a first chordal seal including a first aft facing planar surface at least partially defined by a first pair of edges located adjacent the inner platform; and a second chordal seal including a second aft facing planar surface at least partially defined by a second pair of edges located adjacent the outer platform, wherein at least one of the first pair of edges is parallel to at least one of the second pair of edges.

10. The vane of claim 9, wherein both of the first pair of edges are parallel to both of the second pair of edges.

11. The vane of claim 10, further comprising a cusp of material located radially inward from the first chordal seal.

12. The vane of claim 11, further comprising a recess on an axially forward side of the cusp from the first chordal seal.

13. The vane of claim 9, wherein a first pair a transition surfaces at least partially define a corresponding one of the first pair of edges.

14. The vane of claim 9, wherein a second pair of transition surfaces at least partially define a corresponding one of the second pair of edges.

15. The vane of claim 9, further comprising a first rail having a first rail aft surface located on an opposite side of the inner platform from the airfoil and a second rail having a second rail aft surface located on an opposite side of the outer platform from the airfoil, wherein the first chordal seal is located on the first rail aft surface and the second chordal seal is located on the second rail aft surface.

16. A method of forming a component for a gas turbine engine comprising:

attaching an airfoil extending between an inner platform and an outer platform to a fixture;

machining a first transition surface to at least partially define a first aft facing planar surface of a first chordal seal adjacent the inner platform while the component is attached to the fixture; and machining a second transition surface to at least partially define a second aft facing planar surface of a second chordal seal adjacent the outer platform while the component is attached to the fixture.

17. The method of claim 16, further comprising forming a cusp spaced outward from the first chordal seal.

18. The method of claim 17, further comprising forming a recess on an opposite side of the cusp from the first chordal seal.

19. The method of claim 16 further comprising:

machining a pair of first transition surfaces to at least partially define the first aft facing surface of the first chordal seal while the component is attached to the fixture; and machining a pair of second transition surfaces to at least partially define the second aft facing surface of the second chordal while the component is attached to the fixture.

20. The vane of claim 14, wherein the first pair of transition surfaces and the second pair of transition surfaces are planar.

* * * * *